US009518805B1

(12) United States Patent
Daniels

(10) Patent No.: US 9,518,805 B1
(45) Date of Patent: Dec. 13, 2016

(54) ARROW FLETCHING SYSTEM

(71) Applicant: Eric Daniels, Morris, GA (US)

(72) Inventor: Eric Daniels, Morris, GA (US)

( * ) Notice: Subject to any disclaimer, the term of this patent is extended or adjusted under 35 U.S.C. 154(b) by 0 days.

(21) Appl. No.: 14/956,592

(22) Filed: Dec. 2, 2015

(51) Int. Cl.
*F42B 6/06* (2006.01)

(52) U.S. Cl.
CPC ..... *F42B 6/06* (2013.01)

(58) Field of Classification Search
CPC ..... F42B 6/06
See application file for complete search history.

(56) References Cited

U.S. PATENT DOCUMENTS 1,842,540 A * 1/1932 Cowdery ..... F42B 6/04 473/586
4,204,307 A * 5/1980 Pfetzing ..... F42B 6/06 29/407.09
5,427,385 A 6/1995 Conrad et al.
6,695,727 B1 2/2004 Kuhn
7,758,457 B2 * 7/2010 Marshall ..... F42B 6/06 473/586
7,892,119 B2 * 2/2011 Marshall ..... F42B 6/06 473/586
8,617,010 B2 12/2013 Marshall, Jr.
D702,802 S 4/2014 Marshall, Jr.
2006/0258491 A1 11/2006 Walsh
2010/0167849 A1 * 7/2010 Malucelli ..... F42B 6/06 473/586
2015/0005115 A1 1/2015 Owen

* cited by examiner

*Primary Examiner* — John Ricci

(57) ABSTRACT

An arrow fletching system for facilitating quick disconnect fletchings on an arrow includes an arrow that has a back end and the back end is open. A tube is removably coupled to the arrow and the tube is positioned on the back end. A plurality of fletchings is provided. The tube engages each of the fletchings such that the tube retains the fletchings on the arrow.

8 Claims, 4 Drawing Sheets

ARROW FLETCHING SYSTEM

BACKGROUND OF THE DISCLOSURE

Field of the Disclosure

The disclosure relates to fletching devices and more particularly pertains to a new fletching device for facilitating quick disconnect fletchings on an arrow.

SUMMARY OF THE DISCLOSURE

An embodiment of the disclosure meets the needs presented above by generally comprising an arrow that has a back end and the back end is open. A tube is removably coupled to the arrow and the tube is positioned on the back end. A plurality of fletchings is provided. The tube engages each of the fletchings such that the tube retains the fletchings on the arrow.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
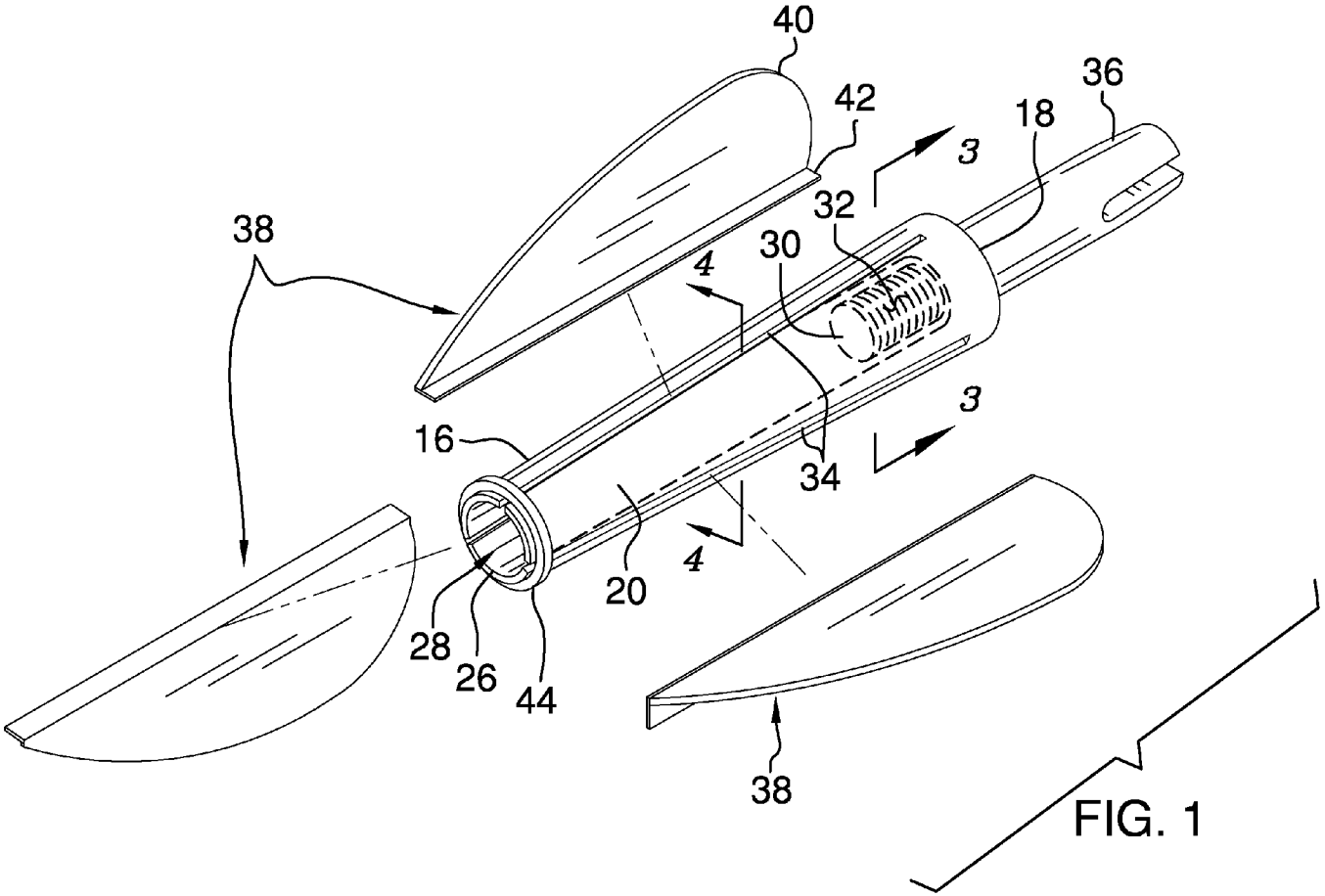
FIG. 1 is an exploded perspective view of an arrow fletching system according to an embodiment of the disclosure.
Figure 2:
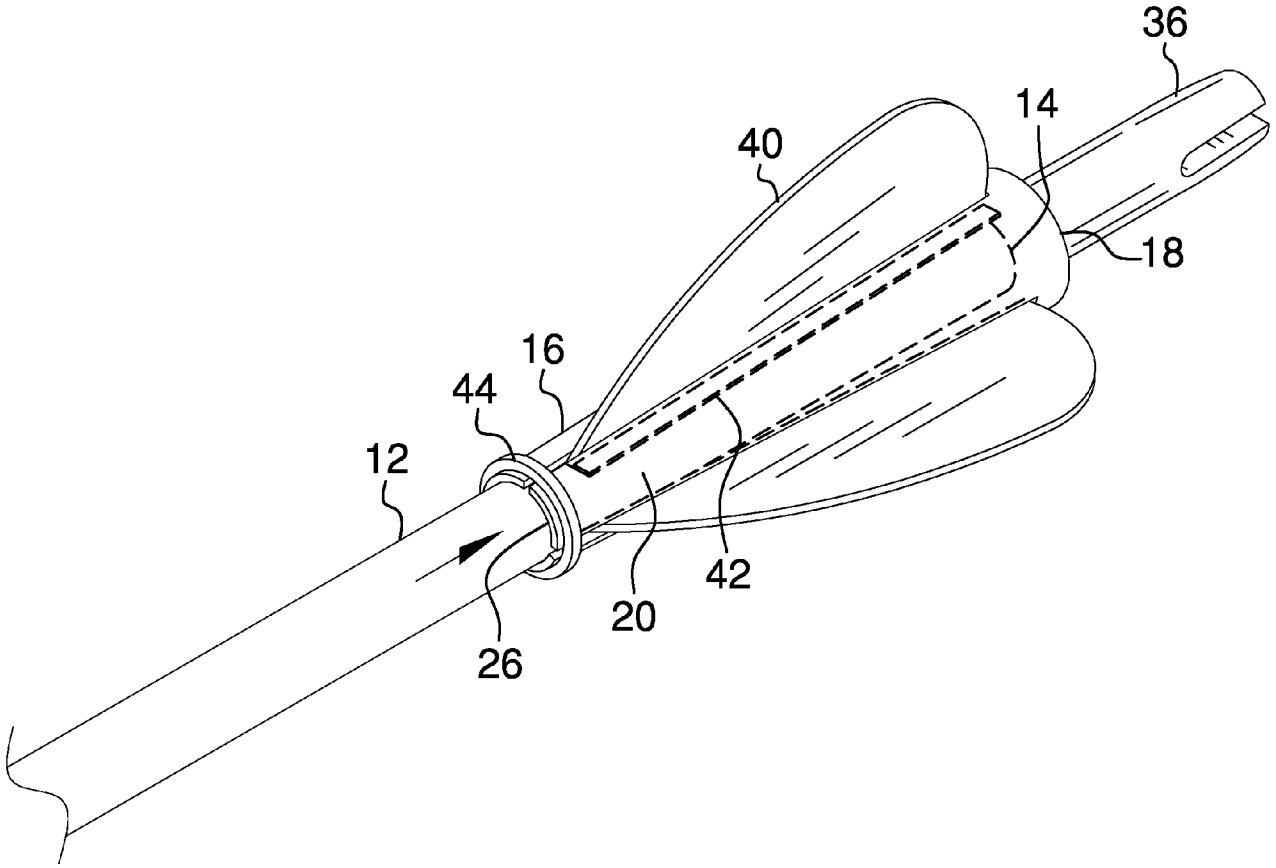
FIG. 2 is a perspective view of an embodiment of the disclosure.
Figure 3:
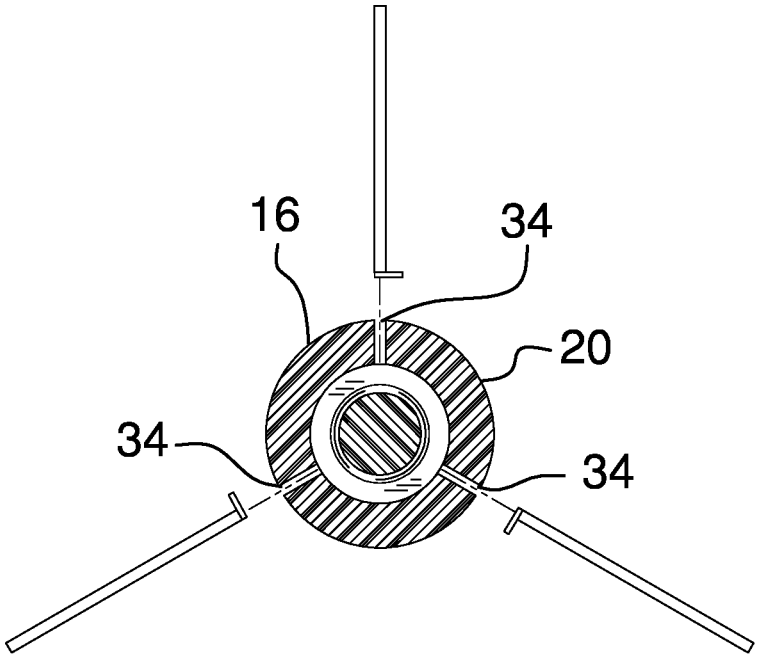
FIG. 3 is a cross sectional taken along line 3-3 of FIG. 1 view of an embodiment of the disclosure.
Figure 4:
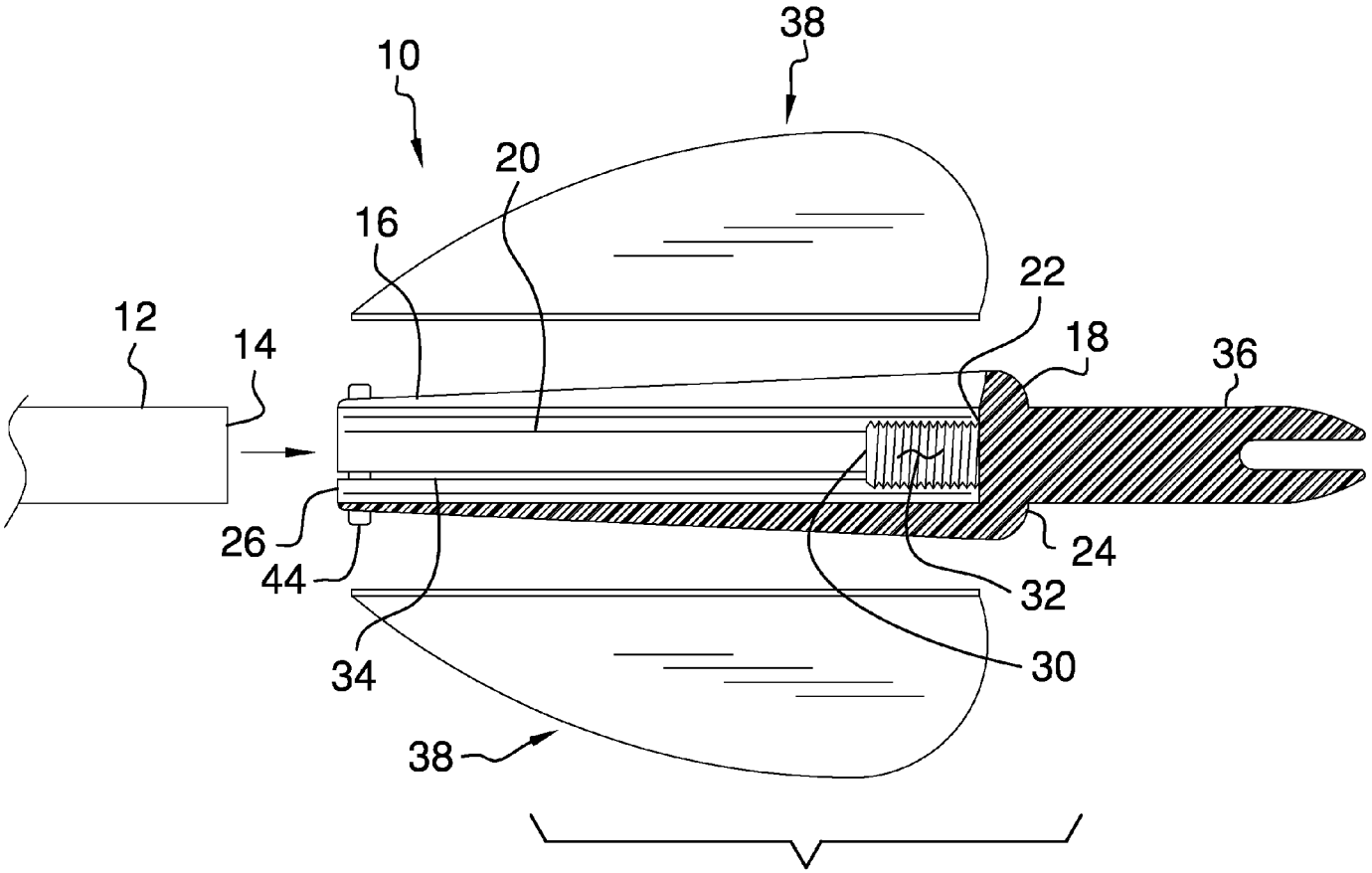
FIG. 4 is a cross sectional view taken along line 4-4 of FIG. 1 of an embodiment of the disclosure.

With reference now to the drawings, and in particular to FIGS. 1 through 4 thereof, a new fletching device embodying the principles and concepts of an embodiment of the disclosure and generally designated by the reference numeral 10 will be described.

As best illustrated in FIGS. 1 through 4, the arrow fletching system 10 generally comprises an arrow 12 that has a back end 14 and the back end 14 is open. The arrow 12 may be an arrow of any conventional design. Moreover, the arrow 12 may be utilized in the convention of archery. The arrow 12 may be launched with a bow or the like.

A tube 16 is removably coupled to the arrow 12 and the tube 16 is positioned on the back end 14. The tube 16 has a first end 18 and a peripheral wall 20 extending away from the first end 18. The first end 18 has a first surface 22 and a second surface 24 and the peripheral wall 20 is positioned on the first surface 22. The peripheral wall 20 is curved such that the tube 16 has a cylindrical shape. The peripheral wall 20 has a distal edge 26 with respect to the first end 18 and the distal edge 26 defines an opening 28 into the tube 16. The tube 16 is substantially hollow.

A coupler 30 is coupled to the first surface 22. The coupler 30 has an outer surface 32 and the outer surface 32 is threaded. The peripheral wall 20 has a plurality of slots 34 extending therethrough. Each of the slots 34 extends from the distal edge 26 toward the first end 18. The slots 34 are evenly spaced apart from each other and are distributed around the peripheral wall 20.

The tube 16 insertably receives the back end 14 of the arrow 12. The back end 14 insertably receives the coupler 30. The coupler 30 threadably engages the arrow 12 such that the tube 16 is removably coupled to the arrow 12. A nock 36 extends away from the second surface 24. Thus, the nock 36 may engage a string on the bow thereby facilitating the arrow 12 to be launched. The nock 36 may be an archery nock of any conventional design.

A plurality of fletchings 38 is provided. The tube 16 engages each of the fletchings 38 such that the tube 16 retains the fletchings 38 on the arrow 12. Each of the fletchings 38 includes a fin 40 and a base 42. The base 42 extends laterally away from the fin 40. Each of the fletchings 38 may comprise archery fletchings or the like.

The fin 40 corresponding to each of the fletchings 38 is slid into an associated one of the slots 34. The base 42 corresponding to each of the fletchings 38 is positioned between the tube 16 and the arrow 12 such that each of the fletchings 38 is removably coupled to the arrow 12. A ring 44 is selectively positioned around the tube 16. The ring 44 is positioned between the fin 40 of each of the fletchings 38 and the distal edge 26 of the tube 16 when the fletchings 38 are positioned in the slots 34. Thus, the ring 44 inhibits the fletchings 38 from sliding outwardly from the slots 34. The ring 44 is comprised of a resiliently stretchable material.

In use, the ring 44 is positioned around the arrow 12. The back end 14 of the arrow 12 is inserted into the tube 16. The coupler 30 threadably engages the back end 14. The fin 40 corresponding to each of the fletching 38 is slid into the associated slot 34. The ring 44 is stretched around the tube 16. The ring 44 is positioned between the fletchings 38 and the distal edge 26 of the tube 16. Thus, the ring 44 compresses the tube 16 against the arrow 12 and the ring 44 retains the fletchings 38 in the tube 16. The spacing of the slots 34 facilitates the fletchings 38 to be evenly spaced around the arrow 12 thereby enhancing aerodynamics of the arrow 12.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An arrow fletching system comprising:

an arrow having a back end, said back end being open;

a tube being removably coupled to said arrow, said tube being positioned on said back end;

a plurality of fletchings, said tube engaging each of said fletchings such that said tube retains said fletchings on said arrow; and wherein said tube has a first end and a peripheral wall extending away from said first end, said first end having a first surface and a second surface, said peripheral wall being positioned on said first surface, said peripheral wall being curved such that said tube has a cylindrical shape, said peripheral wall having a distal edge with respect to said first end, said distal edge defining an opening into said tube.

2. The system according to claim 1, wherein said tube includes a coupler being coupled to said first surface, said coupler having an outer surface, said outer surface being threaded.

3. The system according to claim 2, wherein said tube insertably receives said back end of said arrow, said back end insertably receiving said coupler, said coupler threadably engaging said arrow such that said tube is removably coupled to said arrow.

4. The system according to claim 1, wherein said peripheral wall has a plurality of slots extending therethrough, each of said slots extending from said distal edge toward said first end, said slots being evenly spaced apart from each other and being distributed around said peripheral wall.

5. The system according to claim 4, wherein each of said fletchings includes a fin and a base, said base extending laterally away from said fin, said fin corresponding to each of said fletchings being slid into an associated one of said slots, said base corresponding to each of said fletchings being positioned between said tube and said arrow such that each of said fletchings is removably coupled to said arrow.

6. The system according to claim 5, further comprising a ring being positioned around said tube, said ring being positioned between said fin and said distal edge of said tube when said fletchings are positioned in said slots such that said ring inhibits said fletchings from sliding outwardly from said slots, said ring being comprised of a resiliently stretchable material.

7. The system according to claim 1, wherein said tube includes a nock extending away from said second surface wherein said nock is configured to engage a string on a bow thereby facilitating said arrow to be launched.

8. An arrow fletching system comprising:

an arrow having a back end, said back end being open;

a tube being removably coupled to said arrow, said tube being positioned on said back end, said tube having a first end and a peripheral wall extending away from said first end, said first end having a first surface and a second surface, said peripheral wall being positioned on said first surface, said peripheral wall being curved such that said tube has a cylindrical shape, said peripheral wall having a distal edge with respect to said first end, said distal edge defining an opening into said tube, said tube having a coupler being coupled to said first surface, said coupler having an outer surface, said outer surface being threaded, said peripheral wall having a plurality of slots extending therethrough, each of said slots extending from said distal edge toward said first end, said slots being evenly spaced apart from each other and being distributed around said peripheral wall, said tube insertably receiving said back end of said arrow, said back end insertably receiving said coupler, said coupler threadably engaging said arrow such that said tube is removably coupled to said arrow, said tube having a nock extending away from said second surface wherein said nock is configured to engage a string on a bow thereby facilitating said arrow to be launched;

a plurality of fletchings, said tube engaging each of said fletchings such that said tube retains said fletchings on said arrow, each of said fletchings including a fin and a base, said base extending laterally away from said fin, said fin corresponding to each of said fletchings being slid into an associated one of said slots, said base corresponding to each of said fletchings being positioned between said tube and said arrow such that each of said fletchings is removably coupled to said arrow; and a ring being positioned around said tube, said ring being positioned between said fin and said distal edge of said tube when said fletchings are positioned in said slots such that said ring inhibits said fletchings from sliding outwardly from said slots, said ring being comprised of a resiliently stretchable material.

* * * * *